US005741161A

United States Patent [19]

Cahaly et al.

[11] Patent Number: 5,741,161

[45] Date of Patent: Apr. 21, 1998

[54] ELECTRICAL CONNECTION SYSTEM WITH DISCRETE WIRE INTERCONNECTIONS

[75] Inventors: James E. Cahaly, West Newbury; George M. Williams, III, Medford, both of Mass.

[73] Assignee: PCD Inc., Peabody, Mass.

[21] Appl. No.: 709,199

[22] Filed: Aug. 27, 1996

Related U.S. Application Data

[60] Provisional application No. 60/009,610, Jan. 4, 1996.

[51] Int. Cl. [6] ..... H01R 9/22

[52] U.S. Cl. ..... 439/709; 439/637

[58] Field of Search ..... 439/709–715, 439/637, 494, 499

[56] References Cited

U.S. PATENT DOCUMENTS

| | | | |
|---|---|---|---|
| 3,660,803 | 5/1972 | Cooney | 439/637 |
| 5,163,854 | 11/1992 | Licht et al. | 439/637 |
| 5,178,558 | 1/1993 | Knox et al. | 439/712 |
| 5,221,218 | 6/1993 | Marach | 439/637 |
| 5,595,505 | 1/1997 | Duke et al. | 439/709 |

*Primary Examiner*—Hien Vu

*Attorney, Agent, or Firm*—Jerry Cohen; Edwin H. Paul

[57] ABSTRACT

An electrical connector for joining individual, electrically conductive wires, to a printed circuit board. The wires may be individual solid or stranded types. A contact, provided within the connector housing, is arranged with a first end forming an area for attaching the wire and with a second end arranged usually with female contacts for connecting to a header on the printed circuit board. The wires are stripped of any insulation and mechanically attached to a contact in the connector. The wire is placed between a pressure plate and an area of the contact. A screw is rotated forcing the pressure plate and the contact area together physically squeezing the wire so that the wire is securely attached to the contact area to provide a good electrical contact. The second end of the contacts forms a female cantilevered contact arranged to mate with a header of a row of male pins soldered to the printed circuit board. The connector provides for offsetting the contact areas on adjacent contacts such that the spacing between the contacts accepting the wire are farther apart that the female contacts accepting the pins on the printed circuit board.

8 Claims, 5 Drawing Sheets

ELECTRICAL CONNECTION SYSTEM WITH DISCRETE WIRE INTERCONNECTIONS

Priority is claimed under 35 U.S.C. § 119 (e) on the Provisional Application No. 60/009,610 of common title, and of common inventorship with the present application, filed on Jan. 4, 1996.

FIELD OF THE INVENTION

The present invention relates generally to electrical connection systems that allow discrete wires to be electrically connected to printed circuit boards. More specifically the present invention relates to two piece electrical assemblies, one piece for terminating and making electrical connections to the discrete wire (which may be solid or stranded) and a mating piece that is fixed to the printed circuit board.

BACKGROUND OF THE INVENTION

Known electrical connection systems designed to connect discrete solid wires or stranded wires to printed circuit boards may be of two types. Both types include a plug which provides a secure mechanical and electrical connection between the wire being terminated and the current carrying member of the plug which, in turn, makes connections to the conductive runs on the printed circuit board via soldering or a header or other such techniques.

The first type, referred to in the art as SEM wire clamp, utilizes a flat pressure plate mounted directly under the head of a screw clamp. The wire is inserted between the pressure plate and the current carrying element of the connector. The current carrying element is attached mechanically or by soldering directly to the etched runs on the printed circuit board. The wire may be wrapped around the shaft of the screw or placed close to one side of the screw shaft. When the screw is rotated the pressure plate forces the wire into intimate contact with the current carrying element of the connector. Often the contact face of the pressure plate is irregular in form in order to provide pressure concentration points for more secure electrical and mechanical connections than if the face were smooth.

The second type is referred to in the art as the moving cage clamp or elevator clamp. A connector element is located within the cage and, as before, is connected to the etched conductor run on the printed circuit board. In this type, an internally threaded cage rises axially with the screw shaft as the screw is rotated. An end of the wire is inserted in the same cage so that with the rotation of the screw the wire is forced into intimate contact with the current carrying element.

One well known prior art system is the one-piece terminal block. The terminal block provides a current carrying male pin which was soldered to plated through holes in a printed circuit board by a through-hole soldering technique. The other ends of each of the contacts of these one piece terminal blocks are arranged with either the SEM type or the moving cage type of wire connections.

Subsequently, two piece or pluggable terminal blocks were used in the industry. One piece was a pin header of male pins constructed in a housing made from one of the known plastic materials well known in the connector art that is soldered to a printed circuit board. The second piece was a housing with cantilevered female contacts constructed to mate with the pins on the pin header. The female contacts are on one end of the current carrying element in the second piece. The other end of the current carrying element is formed into a SEM wire clamp or a moving cage clamp, both described above.

The moving cage contacts are manufactured with center to center spacings of 0.200 inches/5.0 mm or, more recently, of 0.150 inches/3.5 mm and 0.100 inches/2.5 mm. The moving cage is rugged and, with the cantilever female contacts, has become the standard two-piece pluggable terminal block of choice for many users in the U.S. market. SEM systems, in contrast, are manufactured with center to center spacings of about 0.325 inches because of the geometry of the pressure plate and the SEM screw itself.

SEM style uses the larger Phillips head screw driver or 3/16 inch flat bladed screw driver. Many users in the U.S. market prefer the larger sized screws over the 1/8 inch flat screw driver that must be used with the moving cage design. However, the SEM system takes up considerably more room than does the moving cage design, and, so, is not as popular as the higher density moving cage design.

It is an object of the present invention to provide a SEM style plug for connecting to discrete wires while mating with the higher density pin header of the moving cage design.

It is another object of the present invention to provide a connector that uses the footprint on the printed circuit board of the moving cage connectors while utilizing the larger screw terminal design for connecting to discrete wires.

It is yet another object of the present design to provide a connector with SEM style spacing at one side and with higher density spacing at the other side for connecting to printed circuit boards.

SUMMARY OF THE INVENTION

The objects are met in apparatus for making electrical connections between separate wires and a printed circuit board. The apparatus includes a housing constructed and arranged with a lower surface and an upper surface, said housing having apertures, each of said apertures having an opening in said upper surface and an opening in said lower surface, said openings in said lower surface arranged substantially in a single straight line row, and said openings in said upper surface arranged substantially not in a single straight line row, and electrical contacts arranged and constructed in said apertures and extending substantially through said housing with first ends in the upper surface openings and second ends in the lower surface openings, said electrical contacts arranged and constructed for making electrical connections at both ends. The openings in said upper surface are arranged to define a plurality of straight lines when the centers of adjacent upper surface openings are joined.

The electrical connection at the first end of the contacts includes a contact area arranged for receiving an electrically conductive wire, said area having a threaded through hole, a screw with a threaded shaft arranged for mating with said threaded through hole, said screw having a slotted head suitable for receiving a screw driver, a pressure plate with a through hole arranged between said contact area and the head of the screw, said screw shaft piecing said through hole, wherein with an electrical wire placed between said contact area and said pressure plate, and where rotating said screw in a manner to drive said screw further into said threaded hole, the wire is mechanically secured to said contact providing electrical conductivity between said wire and said contact area. Alternatively in a preferred embodiment the through hole is constructed so as to not interfere with the screw shaft and the nut is provided threaded onto the screw shaft wherein rotating the screw tightens the wire between the pressure plate and the contact area.

The distance from center to center of adjacent openings on the lower surface is smaller than the distance from center to center of adjacent openings on the upper surface.

In a preferred embodiment, the housing is constructed of two portions which may be joined or attached by adhesive, by mechanical snaps, or by ultrasonic or other such welding.

Other objects, features and advantages will be apparent from the following detailed description of preferred embodiments thereof taken in conjunction with the accompanying drawings in which:

DETAILED DESCRIPTION OF PREFERRED EMBODIMENTS

Figures 1A, 1B:
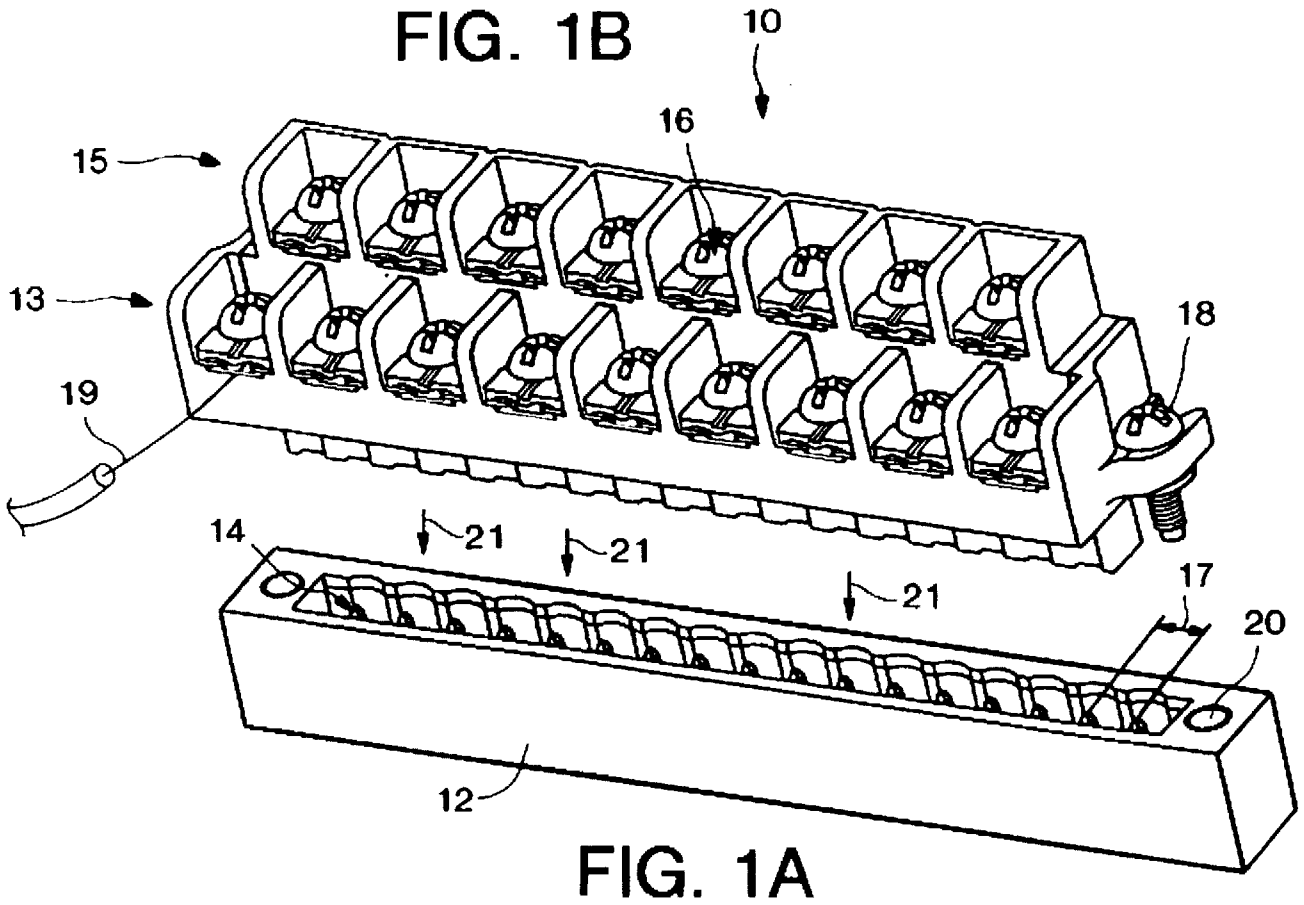
FIG. 1A and 1B are perspective views of a preferred embodiment of the present invention.

FIG. 1A shows a header 12 with male pins 14. FIG. 1B shows a plug 10 constructed and arranged to mate with the header 12. Both the plug and the header are made of insulating materials that are well known in the connector art. On FIG. 1B a SEM style screw 16 is arranged in two rows a lower row 13 and an upper row 15. The upper row is offset both vertically and horizontally from the lower row. In other preferred embodiments (not shown) the two rows may take other forms in both the vertical and horizontal directions, e.g. continuously changing offsets where the SEM screws are on multiple vertical levels and on multiple horizontal rows. The patterns may be arcs of curved figures or incremental steps on the multiple levels. In fact, any offset arrangement, vertically and/or horizontally, may be used. But in each instance, the housing 10, with SEM screws are on a center to center spacing that is larger than the center to center spacings 17 of the header pins, mates properly with the header 12. A discrete wire 19 is secured under the SEM screw which electrically connects the wire to the current carrying contact area 31 in the housing. A female contact 22 (shown in FIG. 2A) is electrically connected to the SEM screw assembly and mates with the male pins in the header. The conductive materials are those well known in the connector art. The plug mates with the header by moving the plug in the direction 21 (or the header may move opposite the direction 21). Jack screws 18 are provided on the plug and mate with receiving threaded insert 20 in the receiving holes in the header.

Figure 2A:
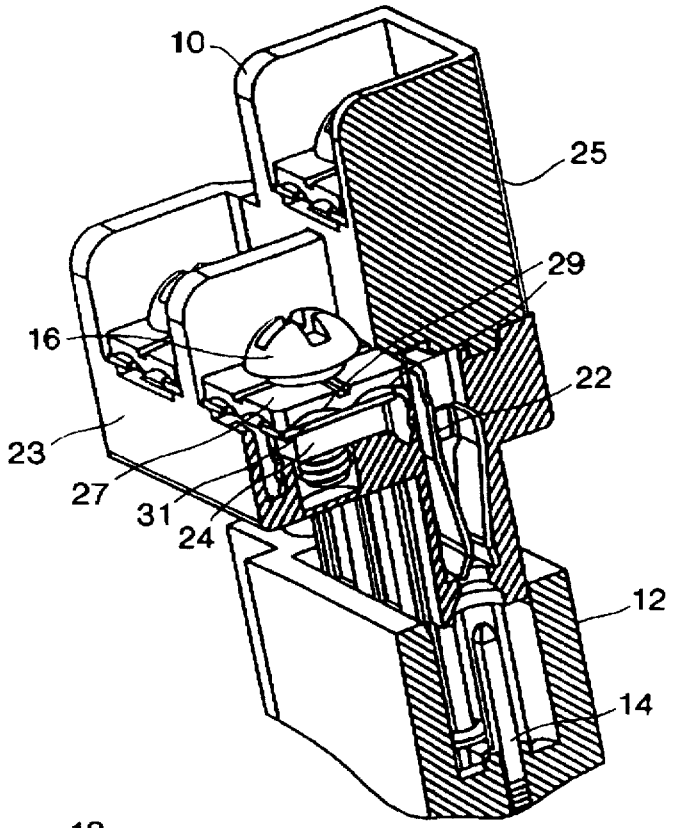
FIG. 2A is a section view of the upper portion of the inventive connector.

FIG. 2A shows a section through one of the lower contacts in the plug 10 just as the plug is entering the header 12. By moving the plug downward the female cantilevered beam contact 22 will engage the pins 14 making electrical connections therebetween. As depicted, the plug 10 is made up of two separate portions, the lower portion 23 and the upper portion 25. One of the lower SEM screws 16 and a washer or pressure plate 27 are shown. The pressure plate has grooves or ridges 29 that provide mechanical advantage for securing and retaining a solid or stranded copper wire. The shaft of the screw passes through the pressure plate 27 and the contact area 31. The lower part of the contact is formed into a dual cantilevered female contacts 22 that accepts the pins 14. A mating nut 24 is provided such that when the SEM screw is rotated counter clock-wise a gap is created between the pressure plate and the contact area 22. A discrete wire (not shown) is inserted into the gap and the SEM screw is rotated clock wise trapping and compressing the wire between the pressure plate ridges and the contact area. The entire contact assembly is contained in the lower housing 23.

Figure 2B:
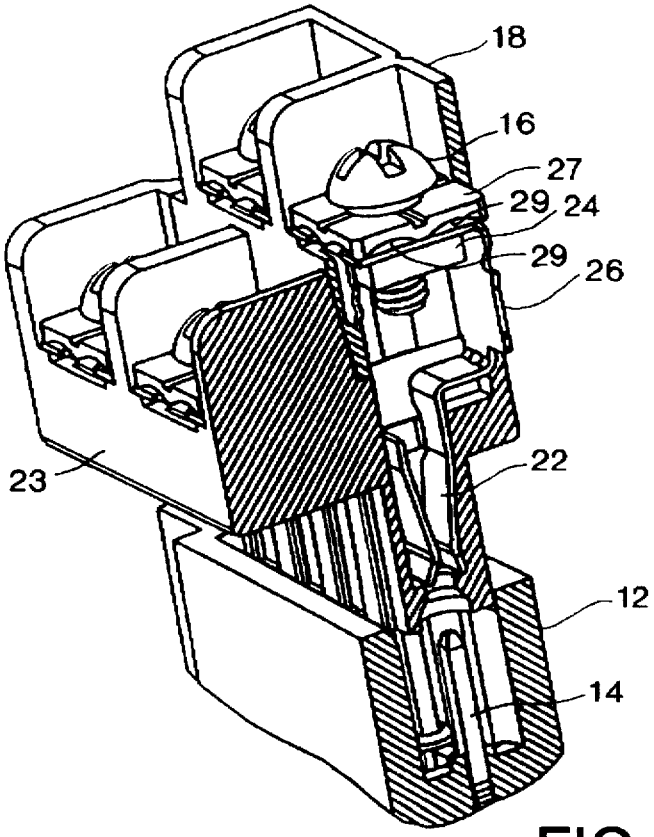
FIG. 2B is a section view of the lower portion of the inventive connector.

FIG. 2B shows the section view of the upper elongated contacts. The SEM screw assembly includes the SEM screw itself 16, the washer or pressure plate 27, the upper part of the female contact 26 and the nut 24 threaded onto the shaft of the SEM screw. The lower part of the female contacts is the cantilevered contact 22 similar to that for the elongated contact of FIG. 2A. The entire contact assembly is located in both the upper and the lower housings. The upper housing may be secured to the lower plug housing 20 by press fitting the contacts into a receiving portion of the lower plug housing 23. The upper and lower housings may be joined wherein the housings snap together, are welded, or attached by adhesive, as is well known in the art.

Figure 3A:
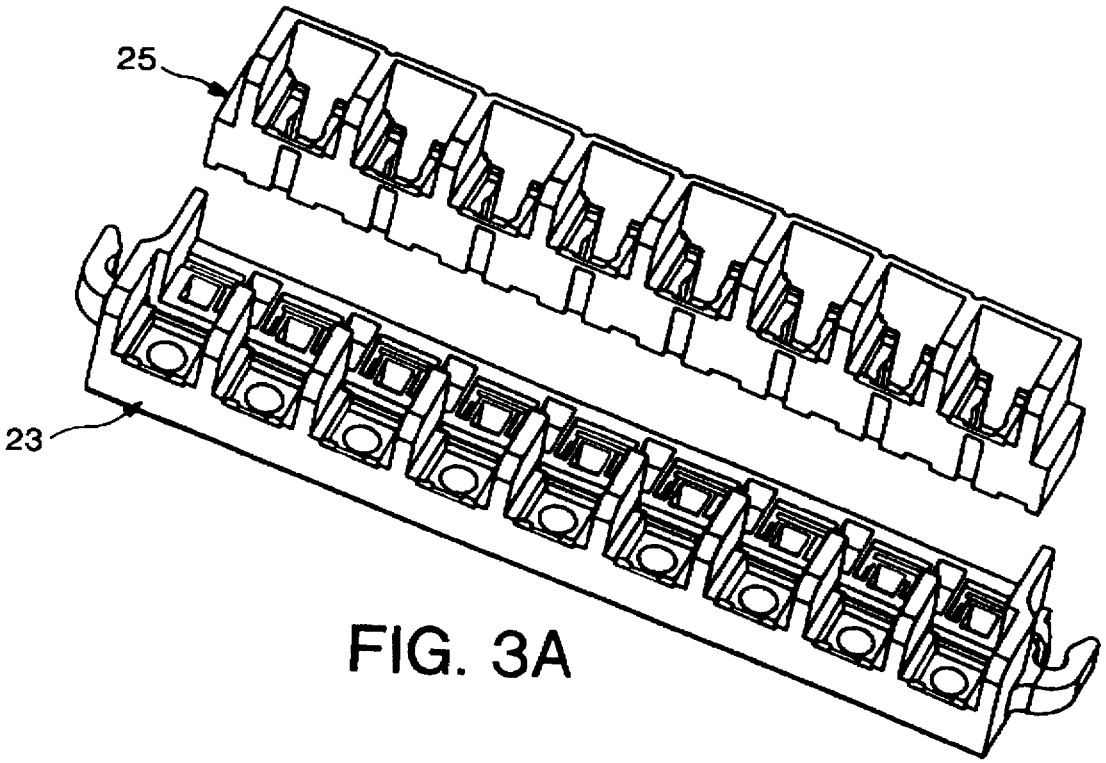
FIG. 3A and 3B are perspective views of separate upper and lower housings of two embodiments before the separate housings are ultrasonically welded together.
Figure 3B:
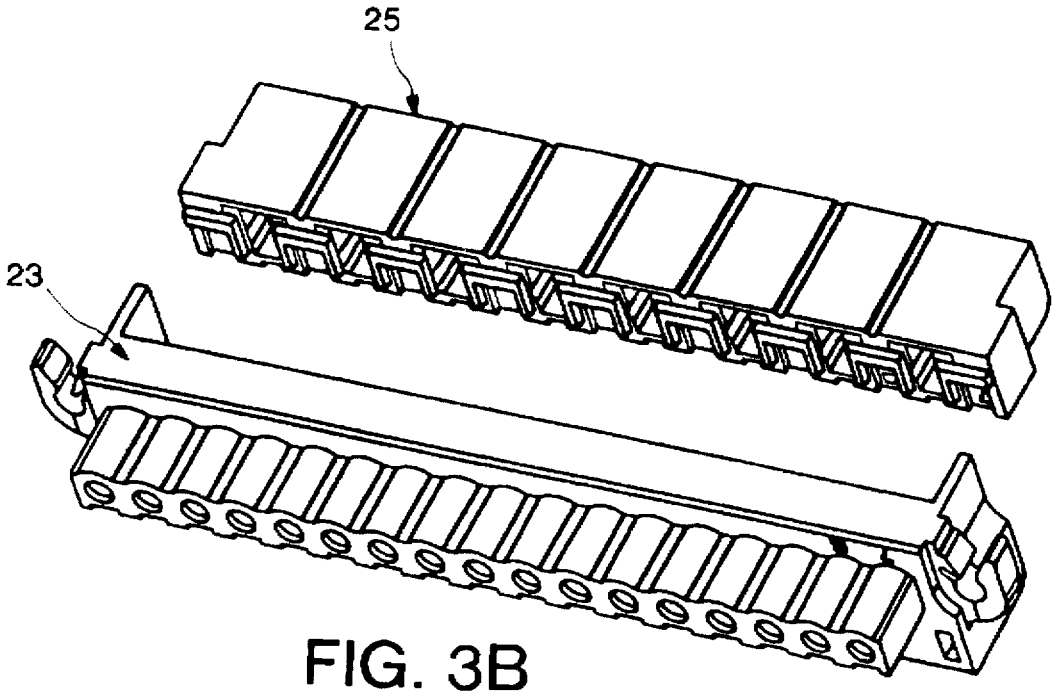

FIGS. 3A and 3B show details of the upper plug housing 25 and the lower plug housing 23. The two pieces together fit into each other in the orientation as shown. When brought together the pieces may be welded or attached with adhesive or combinations thereof. The two pieces may also be arranged to snap together by using interlocking extensions and receptacles or hooks as is well known in the connector art.

Figure 4A:
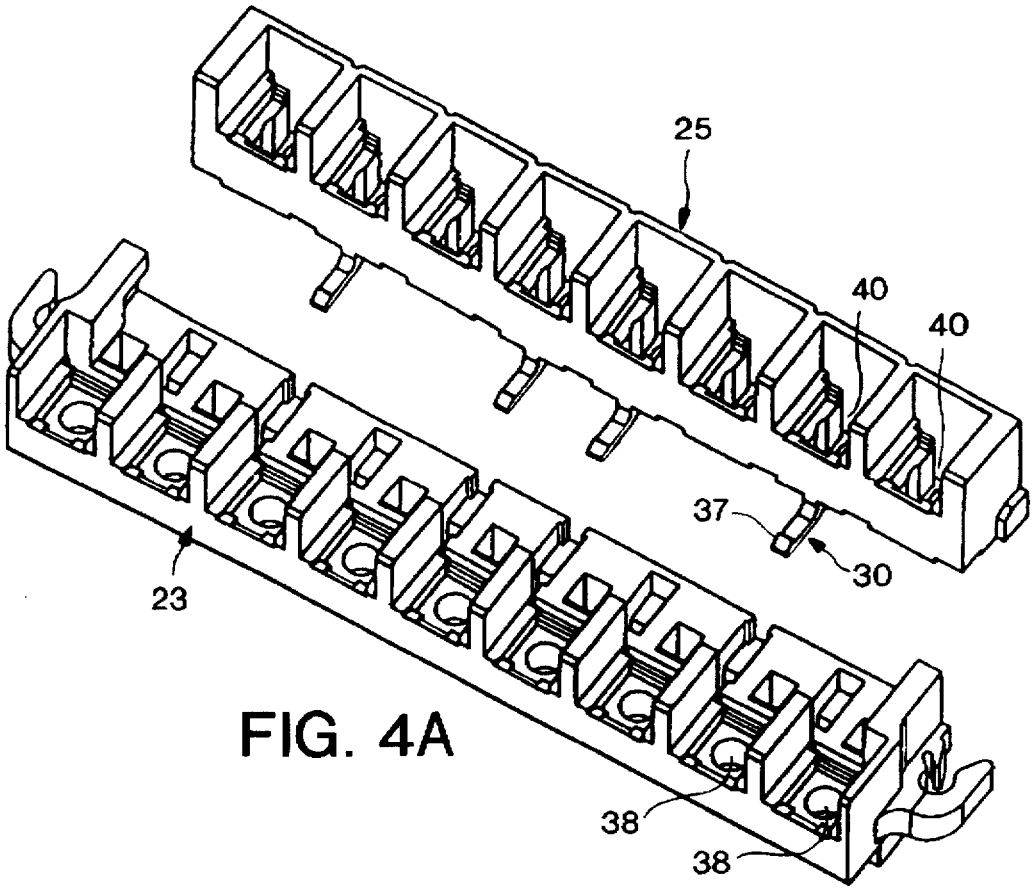
FIG. 4A and 4B are perspective views of separate upper and lower housings that snap together.
Figure 4B:
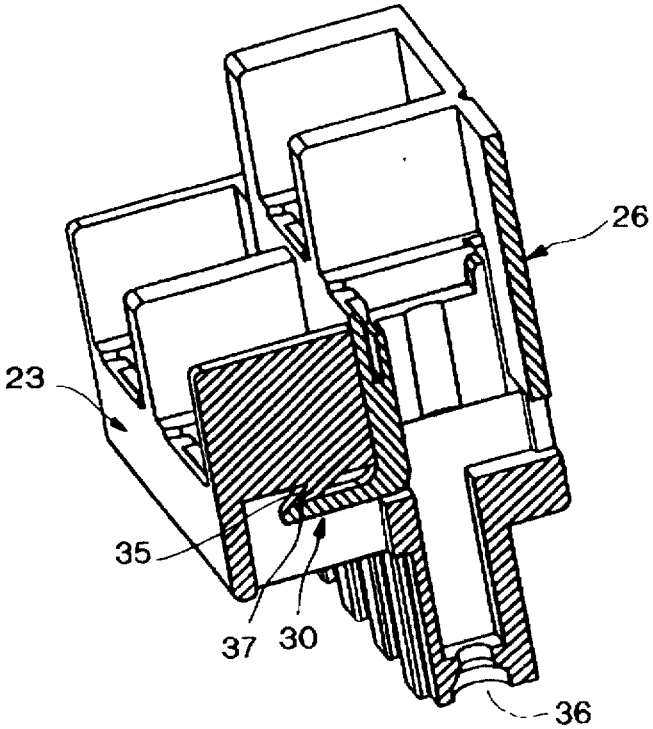

FIGS. 4A and 4B show the upper plug housing 25 with mechanical extensions 30 with hooks 37 formed at the ends. The lower plug housing 23 has abutments 35 that engage the hooks 37 to secure the upper and lower plug housings together. In this preferred embodiment all of the openings 36 on the lower surface are arranged in the lower plug housing 28, but only about half 38 of the upper surface openings are in the lower housing. The other half 40 are in the upper plug housing 25. Alternate upper surface openings are in different housings in this embodiment, however, other arrangements of alternating pairs or more may be arranged on the lower or the upper housing, and since there may be an odd number of contacts together with the arrangement the distribution of the number of upper surface openings on the lower plug housing compared to the upper plug housing will be substantially 50—50. But, one, two or more upper surface openings may be found on one housing as compared to the other housing depending upon the particular embodiment.

Figure 5A:
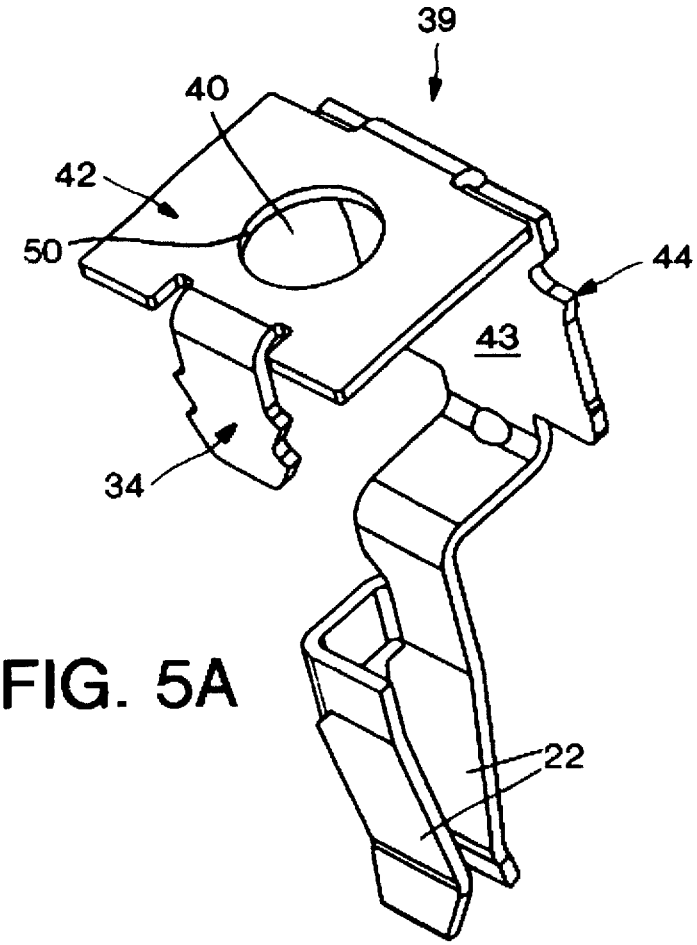
FIG. 5A and 5B are detail views of the contact arranged for the upper and the contact arranged for the lower portions of the connector housing.
Figure 5B:
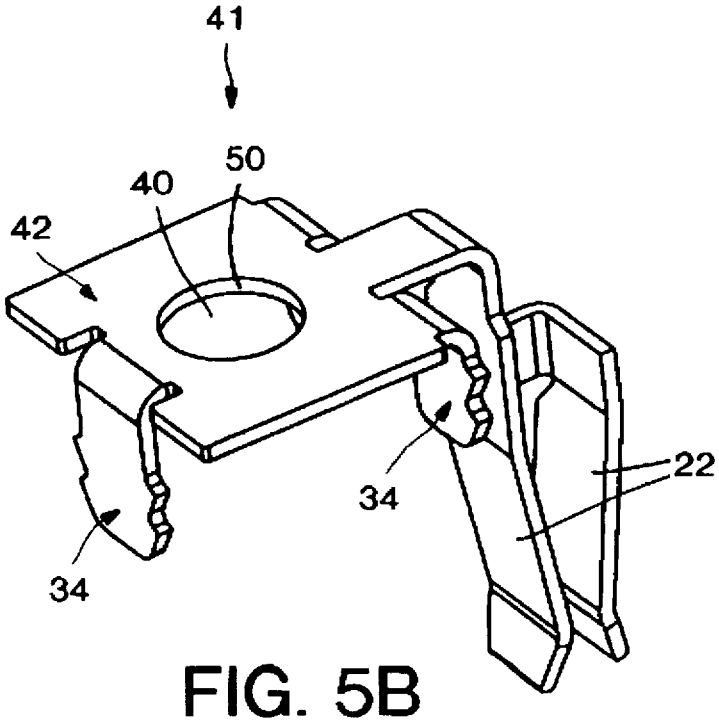

FIGS. 5A and 5B show details of the two types plug contacts, an extended contact 39 for use with the upper plug housing, and a shorter contact 41 for use with the lower plug housing. Both of these contacts have a bottom end that is formed into dual cantilevered female contacts 22. In both the extended and the shorter contacts, the contacts have a through hole 40 that accepts the shaft of the SEM screw. In some preferred embodiments the holes may be threaded 50 or self tapping so that a tightening nut is not needed. There is a platform area 42 that makes contact with the discrete wire (not shown here). In addition, for the upper contact, there is an extension 34 arranged on one side of the platform contact area which is constructed to protrude into the housing material to secure the contact within the upper housing. The elongated part 43 of the contact for the upper plug housing has serrated edges 44 that are also constructed to be within the housing material to form a strong mechanical attachment of the contact to the upper plug housing. The contact 41 for the bottom plug housing has extensions 34 arranged on both sides of the platform contact area. These extensions are constructed to be within the lower plug housing to form a strong mechanical attachment of the contact to the lower plug housing.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. An electrical connection apparatus comprising:

a housing constructed and arranged with an upper portion and a bottom portion, a lower row of apertures and an upper row of apertures formed in said upper portion, wherein said apertures in said upper row are staggered with respect to said lower row of apertures, said adjacent apertures in the upper and the lower rows defining a first spacing therebetween, wherein said first spacings accommodate discrete electrical lead wire connections, said apertures in the lower and the upper rows connected by through holes to a row of apertures in the bottom portion of the housing, said apertures in said bottom portion defining a second spacing therebetween, wherein said first spacings are larger than said second spacings electrical contacts arranged and constructed in and extending substantially through said housing from said apertures in said upper portion of said housing to said apertures in said bottom portion, wherein said electrical contacts are designed to accommodate said stagger, said electrical contacts having two ends, a first end having contact area for connecting to said discrete electrical lead wire, and a second end including a contact area for connecting to a male or female contact of a mating header.

2. An electrical connection apparatus as in claim 1 further comprising extensions constructed on said electrical contacts, said extensions arranged to mechanically retain said contacts in said housing.

3. An electrical connection apparatus as in claim 1 wherein said electrical connection at the first end of the electrical contacts arranged in the upper portion of the housing comprises:

contact area arranged on said contact end for receiving an electrically conductive wire, said contact area having a threaded through hole, a screw with a threaded shaft arranged for mating with said threaded through hole, said screw having a slotted head suitable for receiving a screw driver, a pressure plate with a through hole arranged between said contact area and the head of the screw, said screw shaft piecing said through hole, wherein, with an electrical wire placed between said contact area and said pressure plate, and where rotating said screw in a manner to drive said screw further into said threaded hole, the wire is mechanically secured to said contact providing electrical conductivity between said wire and said contact area.

4. An electrical connection apparatus as in claim 3 wherein said contact area has a through hole without threads, and further comprising a nut threaded onto the shaft of the screw, said nut positioned with said pressure plate between the nut and the screw head.

5. An electrical connection apparatus as in claim 1 wherein said housing comprises a first and a second housing that mate together, said first housing having all of said lower row and bottom row apertures, and said second housing having the upper row of apertures.

6. An electrical connection apparatus as in claim 5, wherein said electrical contacts comprise a first contact and a second contact, said first contact constructed within said first housing, and where said second contact is constructed within both first and second housings.

7. An electrical connection apparatus as in claim 1 wherein the electrical connection at the second end of the electrical contacts arranged at the bottom row of apertures comprise dual beam female contacts.

8. An electrical connection apparatus comprising:

a first housing, a second housing constructed and arranged to mate with said first housing forming a unified housing defining an upper portion and a bottom portion of said unified housing with an upper row of apertures, a lower row of apertures formed in said upper portion, and a row of apertures in said bottom portion arranged substantially in a single straight line row, and said apertures in said upper row staggered with respect to said apertures in said lower row, and wherein spacings of adjacent of said apertures in said upper portion are larger that spacings of said apertures in said bottom portion when measured center to center, wherein said larger spacings accommodate discrete wire connections, electrical contacts arranged and constructed in said apertures and extending substantially through said housing from said upper portion to said bottom portion, said electrical contacts having first ends arranged in apertures in the upper portion for making electrical connections to discrete wires and second ends arranged in the apertures in the bottom portion for making electrical connections to male or female pins of a mating header, and wherein each of said first ends includes a contact area arranged for receiving an electrically conductive wire, each of said contact areas having a through hole, and where each of said second ends includes dual beam female contacts, and extensions are constructed on said electrical contacts, said extensions arranged to mechanically engage said housing such that said contacts are secured to said housing, a screw with a threaded shaft arranged to extend through said hole, said screw having a slotted head suitable for receiving a screw driver, a pressure plate with a through hole, said pressure plate arranged between said contact area and the head of the screw, a nut threaded onto the shaft of the screw, said nut positioned with said pressure plate between the nut and the screw head, wherein, with an electrical wire placed between said contact area and said pressure plate, the wire is mechanically secured to said contact providing electrical conductivity between said wire and said contact area by tightening said screw.

* * * * *